US010021935B2

(12) United States Patent
Ringholz

(10) Patent No.: US 10,021,935 B2
(45) Date of Patent: Jul. 17, 2018

(54) INTERCHANGEABLE STRAP CLOSURE SYSTEM FOR FOOTWEAR

(71) Applicant: Plae Inc., San Francisco, CA (US)

(72) Inventor: Ryan Ringholz, Mill Valley, CA (US)

(73) Assignee: PLAE, INC., San Franisco, CA (US)

( * ) Notice: Subject to any disclaimer, the term of this patent is extended or adjusted under 35 U.S.C. 154(b) by 94 days.

(21) Appl. No.: 13/836,655

(22) Filed: Mar. 15, 2013

(65) Prior Publication Data

US 2013/0318827 A1 Dec. 5, 2013

Related U.S. Application Data

(60) Provisional application No. 61/653,413, filed on May 31, 2012.

(51) Int. Cl.

| | |
|---|---|
| ***A44B 1/04*** | (2006.01) |
| ***A44B 11/25*** | (2006.01) |
| ***A44B 17/00*** | (2006.01) |
| ***A43B 3/26*** | (2006.01) |
| ***A43C 11/00*** | (2006.01) |
| ***A43B 3/24*** | (2006.01) |
| ***A43C 11/22*** | (2006.01) |

(Continued)

(52) U.S. Cl.

CPC ..... *A43B 3/24* (2013.01); *A43C 11/008* (2013.01); *A43C 11/1493* (2013.01); *A43C 11/22* (2013.01); *A43C 11/24* (2013.01)

(58) Field of Classification Search

CPC ... A43B 1/0027; A43B 1/0054; A43B 1/0072; A43B 3/0031; A43B 3/0078; A43B 23/24; A43B 3/24; A43C 11/02; A43C 11/06; A43C 11/08; A43C 11/008; A43C 11/00; A43C 11/22; A43C 11/24; A43C 11/1493; A43C 11/004; A43D 999/00

USPC ..... 36/97, 99, 50.1, 51, 58.5; 24/713.6, 24/68 SK, 71 SK, 578.15

See application file for complete search history.

(56) References Cited

U.S. PATENT DOCUMENTS 785,179 A 3/1905 McIntyre
808,028 A * 12/1905 Ellis ..... A43C 11/18 12/113

(Continued)

FOREIGN PATENT DOCUMENTS

CA 935640 A1 10/1973
DE 20007441 U1 9/2000

(Continued)

OTHER PUBLICATIONS

International Search Report and Written Opinion issued by the U.S. Patent and Trademark Office as the International Searching Authority in corresponding International Application No. PCT/US13/43637 dated Oct. 21, 2013 (9 pgs.).

(Continued)

*Primary Examiner* — Jameson Collier

(74) *Attorney, Agent, or Firm* — Wilmer Cutler Pickering Hale and Door LLP

(57) ABSTRACT

Footwear is provided with a closure system that is easily replaceable by the user. The closure system includes a strap that is preferably secured to the shoe through a hook and loop fastener. The strap is interchangeable and can include a variety of colors, designs, logos. The footwear can include multiple straps.

14 Claims, 2 Drawing Sheets

(51) Int. Cl.
*A43C 11/24* (2006.01)
*A43C 11/14* (2006.01)

(56) References Cited

U.S. PATENT DOCUMENTS 2,032,280 A * 2/1936 Grosshans ..... A41F 3/02 24/578.15
3,009,221 A 11/1961 Firari
4,079,527 A * 3/1978 Antonious ..... 36/51
4,144,621 A * 3/1979 Green ..... A43C 11/22 24/300
4,387,517 A * 6/1983 Annovi ..... 36/118.2
RE32,585 E * 2/1988 Antonious ..... 36/50.1
4,724,625 A * 2/1988 Sartor ..... 36/117.8
4,733,439 A * 3/1988 Gentry ..... A43B 3/0078 206/338
4,901,452 A * 2/1990 Wang ..... 36/50.1
4,907,352 A * 3/1990 Ginsberg ..... 36/50.1
5,042,120 A * 8/1991 Nichols ..... A43C 1/04 24/713.2
5,109,613 A * 5/1992 Van Dyke ..... 36/89
5,148,614 A * 9/1992 Kelly ..... A43B 11/00 36/1
5,230,171 A * 7/1993 Cardaropoli ..... 36/50.1
5,271,130 A * 12/1993 Batra ..... 24/714.6
5,412,852 A 5/1995 Smaragdas
5,557,864 A * 9/1996 Marks ..... 36/50.1
5,692,320 A * 12/1997 Nichols ..... A43C 1/04 36/170
5,894,640 A * 4/1999 Dewey ..... 24/306
6,393,733 B1 * 5/2002 London et al. ..... 36/91
6,543,157 B2 * 4/2003 Pan ..... A43B 3/122 36/101
7,036,194 B2 * 5/2006 Tricker ..... 24/713
7,219,445 B2 * 5/2007 Stern ..... A43B 3/103 36/100
7,437,837 B2 * 10/2008 Jacobs ..... 36/50.1
7,591,084 B2 * 9/2009 Santa Ana ..... A43B 1/0054 36/100
2004/0134100 A1 * 7/2004 McVicker ..... 36/50.1
2004/0226189 A1 * 11/2004 Semitka ..... 36/50.5
2005/0044747 A1 * 3/2005 Doody ..... 36/50.1
2007/0006430 A1 * 1/2007 Issler ..... 24/591.1
2007/0101615 A1 * 5/2007 Munns ..... 36/50.1
2007/0175064 A1 * 8/2007 Culton ..... A43B 1/0081 36/7.1 R
2008/0086910 A1 4/2008 Kim
2008/0235987 A1 10/2008 Kaufman
2009/0217550 A1 * 9/2009 Koo ..... 36/91
2010/0184349 A1 * 7/2010 Hernandez ..... A43B 3/0078 446/71
2010/0313445 A1 12/2010 Hochdoerffer
2010/0319219 A1 * 12/2010 Attilieni ..... A43C 11/24 36/101
2010/0325849 A1 * 12/2010 Clayton ..... 24/713.6

FOREIGN PATENT DOCUMENTS

EP 400213 A1 * 12/1990 ..... A43B 5/00
FR 553978 A * 6/1923
GB 346781 A 4/1931
GB 855207 A * 11/1960
JP 52-129551 3/1977
JP 1-139708 9/1989
WO WO-2011159301 A1 12/2011

OTHER PUBLICATIONS

Supplemental European Search Report issued in EP13797196.6, dated Jan. 22, 2016, 8 pages.

* cited by examiner

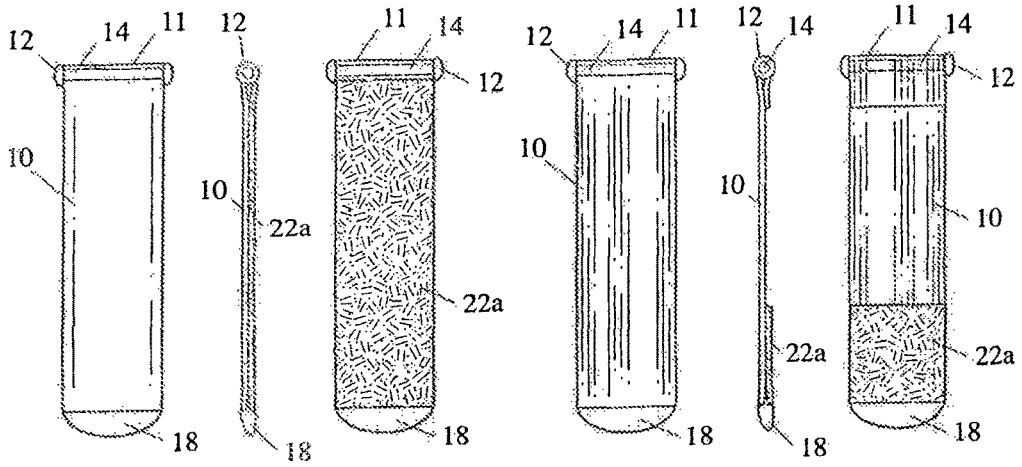
FIG. 1A FIG. 2A FIG. 3A FIG. 1B FIG. 2B FIG. 3B
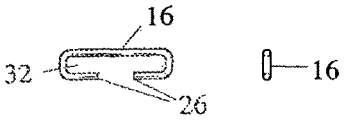
FIG. 4
FIG. 5
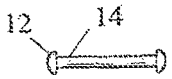
FIG. 6
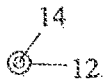
FIG. 7
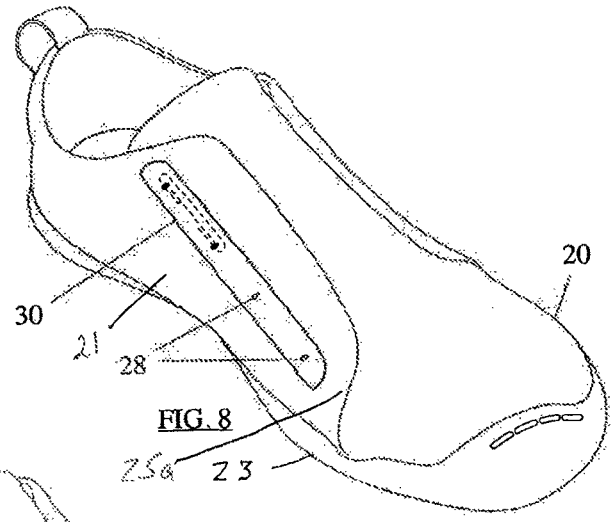
FIG. 8
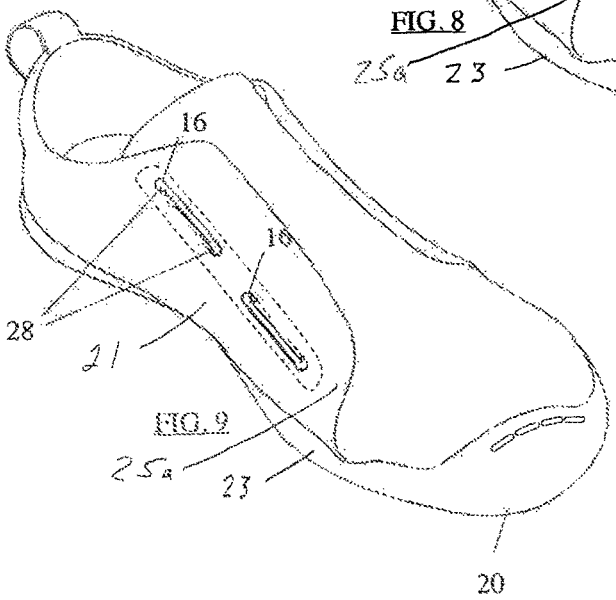
FIG. 9

INTERCHANGEABLE STRAP CLOSURE SYSTEM FOR FOOTWEAR

RELATED APPLICATIONS

This application claims priority to U.S. Provisional Application No. 61/653,413 filed on May 31, 2012 which is incorporated herein by reference.

BACKGROUND OF THE INVENTION

Footwear, in particularly children's footwear, is available in a wide range of colors and styles. As styles and tastes are constantly changing, it is not unusual for any person to own multiple pairs of shoes. In the case of children's footwear, because children frequently outgrow shoes, buying multiple pairs of shoes of different styles for a child can become quite expensive as the shoes are often outgrown before they are worn out. Furthermore, it is often the case that children and parents are not aligned on the style of shoe to purchase. Demand for customized products is growing but traditional footwear manufacturing techniques require long lead times. Not only do such long lead times eliminate the possibility for immediate customization with footwear, but the typical manufacturing process requires customers to wait several weeks for delivery of a customized product.

It is therefore an object of the present invention to provide footwear which is desige the user can alternate the appearance.

SUMMARY OF THE INVENTION

Accordingly, footwear is provided with a closure system that is easily replaceable by the user. The closure system includes a strap that has one end of the strap preferably secured to the shoe through a hook and loop fastener and the other end secured to the shoe through a lop and anvil combination. The strap is interchangeable and can include a variety of colors, designs, logos.

These and other objects and features of the present invention will be more fully understood from the following detailed description which should be read in light of the accompanying drawings in which corresponding reference numerals refer to corresponding parts throughout the several views.

BRIEF DESCRIPTION OF THE DRAWINGS

FIG. 1A is a top plan view of a static interchangeable strap used in a closure system of the present invention.

FIG. 1B is a top plan view of a dynamic interchangeable strap used in a closure system of the present invention.

FIG. 2A is a side plan view of the strap shown in FIG. 1A.

FIG. 2B is a side plan view of the strap shown in FIG. 1B.

FIG. 3A is a bottom plan view of the strap shown in FIG. 1A.

FIG. 3B is a bottom plan view of the strap shown in FIG. 1B.

FIG. 4 is a top plan view of a preferred D-ring used in a closure system of the present invention.

FIG. 5 is a side elevational view of the D-ring shown in FIG. 4.

FIG. 6 is a top plan view of an interchangeable strap anchor used in a closure system of the present invention.

FIG. 7 is a side view of the strap anchor shown in FIG. 6.

FIG. 8 is a perspective view of a shoe with the attachment mechanism for a D-ring of the type shown in FIG. 4.

FIG. 9 is a perspective view of a shoe with a D-ring of the type shown in FIG. 4 inserted into a shoe.

DETAILED DESCRIPTION OF THE INVENTION

Figure 10:
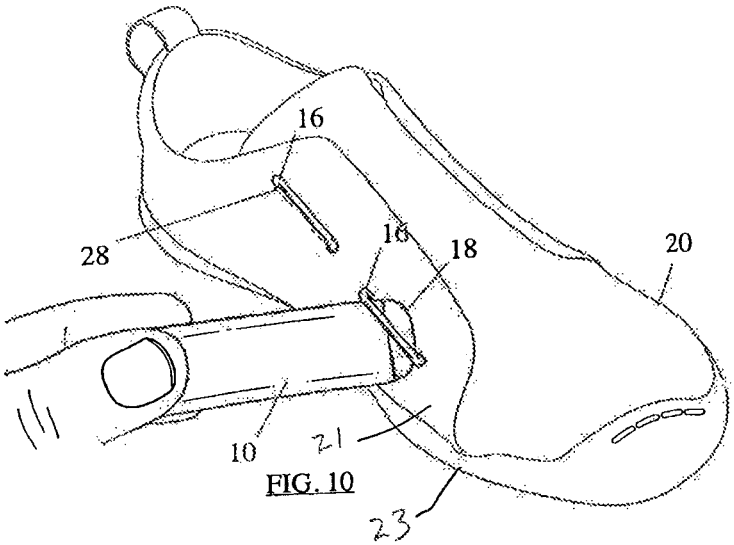
FIG. 10 is a perspective view of a shoe with a strap shown in FIG. 1A being inserted through a D-ring of FIG. 4.

FIGS. 1A, 2A and 3A show multiple views of a static interchangeable strap 10 where any static material (i.e., material that cannot be stretched) suitable for footwear is wrapped around the core 12 of a dumbbell shaped anchor 14 (see FIG. 6). The wrapped material of the strap 10 should sit flush (i.e, aligned to the edge) with the anchor knobs 12. At least one D-ring 16 is mounted to a shoe 20 (see FIG. 8 and FIG. 11) so that the opening of the D-ring 16 extends above the top surface of one flap of an upper of shoe 20, and the strap 10 when inserted in D-ring 16 will be positioned entirely above an outer surface of said shoe 20. The total diameter of knob 12 as well as the portion 11 of the strap 10 wrapped around the anchor 14 will be greater than the inner dimension of the D-ring 16 to provide a secure anchor for the typical force applied to a typical strap closure for footwear. In some embodiments only the knobs 12 of the D-Ring have diameters greater than height of the D-Ring. The tip 18 of the interchangeable strap 10, is secured on the alternate side of the shoe 20 by way of typical hook-and-loop fastener 22*a*, 22*b*.

FIGS. 1B, 2B and 3B show an alternate embodiment of the strap 10. In this embodiment the strap 10 is secured in the same manner previously described, however the strap 10 is constructed from a material with dynamic properties (i.e., elastic) to allow the shoe to be more easily slipped on. In this embodiment, the footprint of the typical loop portion 22*a* of the hook-and-loop fastener 22*a*, 22*b* is reduced (when compared to the strap shown in FIGS. 1A, 2A and 3A) on the backside of the strap 10 to allow for full range of dynamic expansion.

The straps 10 are interchangeable to allow straps 10 with differing properties, such as, differing material, color, print and function (static vs. dynamic) to be swapped for one another.

FIG. 4 and FIG. 5 show the preferred D-ring 16. D-ring 16 may be made from multiple materials and may be of varying shapes and sizes, but the preferred material is metal in the form of a rounded rectangle. The D-ring 16 may also be affixed to the shoe 20 in multiple ways to ensure that the opening in D-ring 16 extends above the top surface of one flap of an upper of shoe 20. The preferred method of securing the D-ring 16 to the shoe 20 is to insert the ends 26 through punched holes 28 (see FIG. 8) in the upper portion of shoe 20 and to secure the ends 26 to the backside of the upper material with additional tear-resistant material 30 for optimal durability.

An embodiment of the strap anchor 14 is shown in FIGS. 6 and 7. The anchor 14 may be made from multiple materials such as metal or plastic and the anchor can be of varying shapes and sizes. The preferred material is thermoplastic polyurethane in the form of a dumbbell, wherein the diameter of the knob 12 is greater than the inner diameter 32 of the D-ring 16.

FIG. 9 shows a D-ring 16 affixed to the upper portion of the shoe 20 without any interchangeable strap 10 attached.

FIG. 10 shows the initial engagement of an interchangeable strap 10, with a preferred D-ring 16. The tip 18 of the interchangeable strap 10, is inserted through the bottom facing side of the D-ring 16 and pulled through the D-ring 16 opening and out the upward facing side until further engagement is prevented by the inability of the larger dimensioned anchor 14 to pass through the smaller inner dimension of the D-ring 16 opening.

Figure 11:
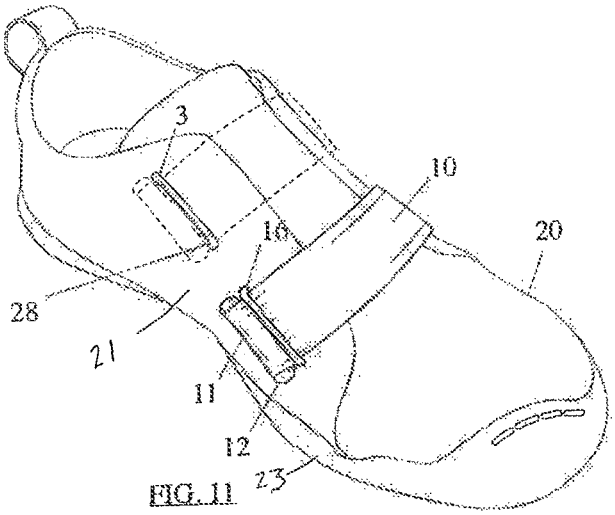
FIG. 11 is a perspective view of a shoe with a strap shown in FIG. 1A being secured to the shoe.
Figure 12:
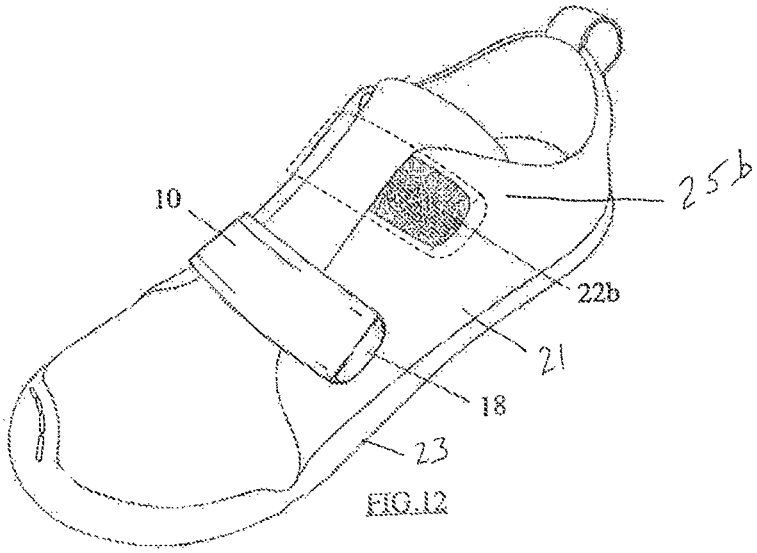
FIG. 12 is a perspective view of a shoe with a strap shown in FIG. 1B being secured to the shoe.

FIGS. 11 and 12 shows a fully engaged interchangeable strap 10. The tip 18 of the interchangeable strap 10 is secured on the alternate side of the shoe 20 by way of typical hook-and-loop fastener mounted on a top surface of flap 25*b*.

The removal of the interchangeable strap 10 follows the reverse sequence. In this case, the hook-and-loop fastener 22*a*, 22*b* is disengaged from the shoe 20 in typical fashion. Then the anchor 12 is pulled out of the D-ring 16 opening until interchangeable strap 10 is free from the D-ring 16 and fully removed from the shoe 10.

While the foregoing invention has been described with reference to its preferred embodiments various alterations and modifications will occur to those skilled in the art. All such alterations and modifications are intended to fall within the scope of the appended claims.

What is claimed:

1. An item of footwear comprising:

an outsole;

an upper mounted on the outsole, said upper having two flaps with a first flap of said two flaps included on a first side of said upper and a second flap of said two flaps included on a second side of said upper, the first flap having an outer surface and the second flap having an outer surface;

at least one ring mounted on said outer surface of said first flap of said upper so that said at least one ring and an opening in said at least one ring extend above said outer surface of said first flap of said upper, said opening extending from said outer surface of said first flap in a direction away from said outer surface of said first flap;

a strap that is completely removable from said upper and is insertable in said at least one ring so that all of said strap is positioned above the outer surfaces of said two flaps of said upper when said strap is inserted in said at least one ring, said strap including a strip of one mating portion of a hook and loop fastener, said strap being inserted in said at least one ring and when said item of footwear is in a tightened state, a first end of said strap abuts said at least one ring and is secured against said at least one ring, said first end of said strap having dimensions that prevent said first end of said strap from passing through said at least one ring and a second end of said strap is secured to a strip of a second mating portion of said hook and loop fastener mounted directly on said outer surface of said second flap of said upper, said first end of said strap secured against said at least one ring on a side of said at least one ring furthest from said second mating portion of said hook and loop fastener.

2. The item of footwear of claim 1 wherein said strap is constructed of a static material.

3. The item of footwear of claim 1 wherein said strap is constructed of a dynamic material.

4. The item of footwear of claim 1 further comprising a strap anchor positioned between two layers of a material of said strap created by folding a portion of said strap over another portion of said strap, said strap anchor having a dumbbell shape with a knob positioned on each of two ends of said strap anchor, each of said knobs having a diameter larger than said opening to prevent said strap anchor from passing completely through said at least one ring.

5. The item of footwear of claim 1 further comprising a second removable strap and said at least one ring includes a second ring.

6. A footwear closure system comprising:

at least one ring mounted on an outer surface of a first flap of a first side of an upper of an item of footwear so that said at least one ring and an opening in said at least one ring extend above said outer surface of said first flap of said upper, said opening extending from said outer surface of said first flap in a direction away from said outer surface of said first flap;

a second flap having an outer surface;

a strap that is completely removable from said upper and is insertable in each of said at least one ring so that all of said strap is positioned above the outer surface of said first flap and above the outer surface of said second flap when said strap is inserted in said at least one ring, said strap including a strip of one mating portion of a hook and loop fastener, said strap being inserted in said at least one ring in said item of footwear and when said item of footwear is in a tightened state, a first end of said strap abuts said at least one ring and is secured against said at least one ring, said first end of said strap having dimensions that prevent said first end of said strap from passing through said at least one ring and a second end of said strap is secured to a strip of a second mating portion of said hook and loop fastener mounted directly on said outer surface of said second flap on a second side of said upper, said first end of said strap secured against said at least one ring on a side of said at least one ring furthest from said second mating portion of said hook and loop fastener.

7. The footwear closure system of claim 6 wherein said strap is constructed of a static material.

8. The footwear closure system of claim 6 wherein said strap is constructed of a dynamic material.

9. The footwear closure system of claim 6 further comprising a strap anchor positioned between two layers of a material of said strap created by folding a portion of said strap over another portion of said strap, said strap anchor having a dumbbell shape with a knob positioned on each end of two ends of said strap anchor, each of said knobs having a diameter larger than said opening to prevent said strap anchor from passing completely through said at least one ring.

10. The footwear closure system of claim 6 further comprising a second removable strap and said at least one ring includes a second ring.

11. A footwear closure system comprising:

at least one ring mounted on an outer surface of a first flap of a first side of an upper of an item of footwear so that said at least one ring and an opening in said at least one ring extend above said outer surface of said first flap of said upper, said opening extending from said outer surface of said first flap in a direction away from said outer surface of said first flap;

a dumbbell shaped strap anchor with two ends, the strap anchor having a knob on each of the two ends of said strap anchor;

a strap that is completely removable from said upper and is insertable in each of said at least one ring so that all of said strap is positioned above an outer surface of said upper when said strap is inserted in said at least one ring, a first end of said strap being positioned around said strap anchor with a portion of said strap folded over another portion of said strap, said strap being positioned between said knobs, said strap being inserted in said at least one ring in said item of footwear and when said item of footwear is in a tightened position, said first end of said strap abuts said at least one ring and a second end of said strap includes a first fastener component that is directly securable to a second fastener component directly mounted on an outer surface of a second flap on a second side of said upper, said first end of said strap secured against said at least one ring on a side of said at least one ring furthest from said second flap.

12. The footwear closure system of claim 11 wherein said strap is constructed of a static material.

13. The footwear closure system of claim 11 wherein said strap is constructed of a dynamic material.

14. The footwear closure system of claim 11 further comprising a second removable strap and said at least one ring includes a second ring.

* * * * *